US005998726A

United States Patent [19]

Tanaka

[11] Patent Number: 5,998,726

[45] Date of Patent: Dec. 7, 1999

[54] MUSICAL SOUND GENERATING SYSTEM WITH CONTROLLED TONE

[75] Inventor: Jiro Tanaka, Hamamatsu, Japan

[73] Assignee: Kabushiki Kaisha Kawai Gakki, Shizuoka-Ken, Japan

[21] Appl. No.: 09/232,942

[22] Filed: Jan. 19, 1999

[30] Foreign Application Priority Data

Jan. 22, 1998 [JP] Japan ..... 10-010783

[51] Int. Cl.[6] ..... G10H 1/057; G10H 1/12; G10H 1/46

[52] U.S. Cl. ..... 84/658; 84/661; 84/663; 84/665; 84/DIG. 7; 84/DIG. 9

[58] Field of Search ..... 84/615–620, 622–633, 84/658–665, 687–690, 692–711, DIG. 7, DIG. 9

[56] References Cited

U.S. PATENT DOCUMENTS

| | | | |
|---|---|---|---|
| 4,129,056 | 12/1978 | Jensen et al. | 84/687 |
| 4,909,121 | 3/1990 | Usa et al. | 84/627 X |
| 5,117,728 | 6/1992 | Shibakawa et al. | 84/633 |
| 5,185,492 | 2/1993 | Ikeya | 84/633 |
| 5,827,987 | 10/1998 | Kosugi | 84/DIG. 9 |

*Primary Examiner*—Stanley J. Witkowski
*Attorney, Agent, or Firm*—Davis and Bujold

[57] ABSTRACT

A musical sound generating system which generates musical sounds having desired tone regardless of the variation of volume setting. In the musical sound generating system, the standard tone control touch curve TCstd, the maximum tone control touch curve Tcmax, and the minimum tone control touch curve TCmin when the amplification factor V is standard (a standard amplification factor Vstd), maximum, and minimum respectively are stored. If the amplification factor is higher than the standard amplification factor Vstd, an interpolation between the standard tone control touch curve TCstd and the maximum tone control touch curve TCmax is performed, and the tone control touch curve TC according to the amplification factor V is obtained. Based on the tone control touch curve, the cut-off frequency F corresponding to the velocity value Tv is determined, and then the tone of the musical sound is controlled by the low pass filter with the cut-off frequency F.

5 Claims, 6 Drawing Sheets

MUSICAL SOUND GENERATING SYSTEM WITH CONTROLLED TONE

FIELD OF THE INVENTION

The invention relates to a musical sound generating system which is used for electronic musical instruments having a keyboard and generates a musical sound corresponding to a pressed key in a volume and a tone which is in accordance with the key pressing speed.

BACKGROUND OF THE INVENTION

In a conventional musical sound generating system used for electronic musical instruments such as an electronic piano, when a key is pressed, a musical sound signal is produced based on the pre-stored waveform data corresponding to the pressed key which is then amplified and converted to a musical sound by a loudspeaker. At the same time, the amplitude of the higher frequencies and the tone of the musical sound to be generated are changed in accordance with the key pressing speed. Specifically, as the key pressing speed is increased, a musical sound with a higher amplitude of high-frequency components, i.e. a musical sound in brighter tone, is generated.

A typical example of an electronic musical instrument of this type is one in which a musical sound signal, based on waveform data, is passed through a low pass filter, the cut-off frequency of which is controlled according to the key press intensity, thereby high-frequency components of the musical sound signal are attenuated. In this electronic musical instrument, when a key is pressed with a strong touch, a higher cut-off frequency is set such that the output is performed with an increased amplitude of high-frequency components, while a lower cut-off frequency is set such that the output is performed with a decreased amplitude of high-frequency components when a key is pressed with a weak touch.

Another example is an electronic musical instrument in which a plurality of musical sound signals having different distributions of the amplitude of frequency components and a plurality of envelope waveforms corresponding to the musical sound signals respectively, are prepared for generating a musical sound by the press of one key. When a key is pressed, a plurality of signals are produced by multiplying each musical sound signal and the corresponding envelope waveform, and by combining the signals with each other a musical sound in a desired tone is generated.

The aforementioned envelope waveform represents variation of the amplitude of a musical sound generated by a musical sound signal with time. In this electronic musical instrument, the tone of the musical sound to be generated can be changed by controlling the amplitude of the plurality of envelope waveforms according to the key press intensity. Specifically, in an electronic musical instrument of this type, when a key is pressed with a strong touch, a musical sound in a bright tone is generated by increasing the amplitude of the envelope waveform corresponding to the musical sound signal having a frequency distribution with a high amplitude of high-frequency components (or by decreasing the amplitude of the envelope waveform corresponding to the musical sound signal having a frequency distribution with a small amplitude of high-frequency components). When a key is pressed with a weak touch, oppositely, a musical sound in a dull tone is generated by decreasing the amplitude of the envelope waveform corresponding to the musical sound signal having a frequency distribution with a high amplitude of high-frequency components (or by increasing the amplitude of the envelope waveform corresponding to the musical sound signal having a frequency distribution with a small amplitude of high-frequency components).

Generally, the volume of musical sounds generated from a loudspeaker is controlled in accordance with the amplification factor of an amplifier, which a user can set. When a user sets the amplification factor low, the user unconsciously tends to press the keys with a strong touch (i.e., rapidly) because the output volume of the loudspeaker is small. As a result, the generated musical sounds include a larger amplitude of high-frequency components, which results in a bright tone thereof. When the user sets the amplification factor high, the user unconsciously tends to press the keys with a weak touch (i.e. slowly), which results in the generated musical sounds with a small amplitude of high-frequency components and thus in a dull tone. Thus, there is a problem that the setting of the amplification factor produces a psychological effect on the user such that the tone of the generated musical sound is different from that which the user desires.

SUMMARY OF THE INVENTION

Wherefore, a principal object of the invention is to provide a musical sound generating system which can generate musical sounds having a desirable tone regardless of volume setting.

To achieve the above object of the invention, there is provided a musical sound generating system which comprises a key press detecting means for detecting which key is pressed by a user and the key pressing speed, a musical sound signal generating means for generating a musical sound signal corresponding to the pressed key in accordance with the key pressing speed when a key press is detected by the key press detecting means, a volume setting means for setting the volume of the musical sound to be generated by the user's operation, and a sound generating means for generating a sound based on the musical sound signal generated by the musical sound signal generating means at the volume set by the volume setting means. The above musical sound signal generating means generates, when the key press is detected by the key press detecting means, a musical sound signal corresponding to the pressed key, with an amplitude of the envelope waveform in accordance with the key pressing speed detected by the key press detecting means and also with the frequency components according to the key pressing speed and the volume set by the volume setting means.

Since, in the musical sound generating system of the invention, the frequency components of the musical sound signals generated are controlled in accordance with both the key pressing speed and the volume setting, a difference of the tone from that which the user desires can be reduced. Thus, a musical sound having a desirable tone can be generated even if the user is affected by the volume setting.

In order to control the frequency components of a musical sound signal in accordance with the key pressing speed and the set volume, it may be effective to amplify the musical sound signal by an amplifier and vary the frequency characteristic of the amplifier's gain according to the key pressing speed and the set volume. However, it is more common to use a filter to control the tone. Therefore, it is preferred that a musical sound signal generating means comprises a musical sound signal producing means for producing a musical sound signal corresponding to a key, when that key is pressed, that controls the amplitude of the envelope waveform corresponding to the musical sound signal in accordance with the key pressing speed, and a filter means to control the frequency components of the musical sound signal in accordance with the key pressing speed and the set volume. According to this construction of a musical sound signal generating means, the filter means can control the musical sound signal by varying its frequency characteristic in accordance with the key pressing speed and the set volume, then filtering the musical sound signal. Thus, the difference of tone from that a user originally requires can be reduced even if the user, influenced by the volume of the sound generated by the sound generating means, unconsciously changes the key pressing speed.

The filter means may be a band pass filter or a low-pass filter, for example, can be used. A band pass filter, however, requires a process and a circuit to attenuate a musical sound signal in the low frequency band, which leads to a complex structure of the filter means. Constitution of a filtering means as a low-pass filter is preferable because it enables an easy control of frequency components by the key pressing speed and the set volume.

An amplifier or a filter is not the only means able to control the frequency components of a musical sound signal in accordance with the key pressing speed and the set volume. According to one aspect of the invention, the musical sound signal generating means comprises a plurality of musical sound signal producing means for producing a plurality of musical sound signals including different frequency components respectively corresponding to the key pressed, the pressing of which is detected by a key press detecting means, a plurality of envelope controlling means for controlling the amplitude of the envelope waveforms corresponding to the musical sound signals produced by a plurality of the musical sound signal producing means in accordance with the key pressing speed, and a musical sound synthesizing means for combining the musical sound signals controlled by a plurality of envelope controlling means and generating the ultimate musical sound signal. Further, at least one of the plurality envelope controlling means is designed to control the amplitude of the envelope waveform corresponding to the musical sound signal in accordance with the key pressing speed and the set volume. In this manner the above measures can desirably bring a simpler structure of the musical sound signal producing means without a filter means.

BRIEF DESCRIPTION OF THE DRAWINGS

The invention will now be described, by way of example, with reference to the accompanying drawings, in which.

DETAILED DESCRIPTION OF THE PREFERRED EMBODIMENT

A preferred embodiment of the invention is described hereafter with reference to the drawings.

Figure 1:
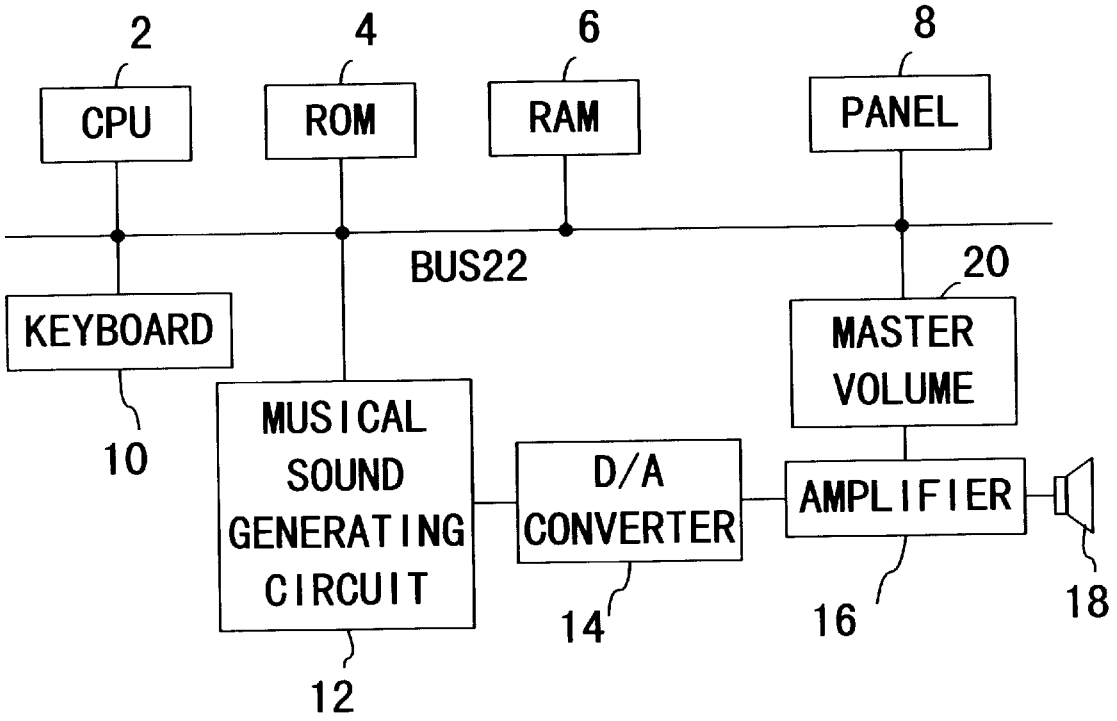
FIG. 1 is a block diagram showing the overall structure of an electronic musical instrument according to an embodiment of the invention.

As shown in FIG. 1, this electronic musical instrument is composed of a CPU 2, a ROM 4, a RAM 6, a panel 8, a keyboard 10, a musical sound generating circuit 12, a DIA converter 14, an amplifier 16, a loudspeaker 18, a master volume control 20, and a bus 22 to connect these components to each other.

The panel 8 is composed of various kinds of switches, such as a selection switch for selecting tone, rhythm pattern and the like, and a ten-key switch for inputting numeric values; a display containing a LED, a LCD, or the like; a scanning circuit for reading the information about each switch under the control of the CPU 2; and a driving circuit for driving the display.

The keyboard 10 is composed of a touch sensor for detecting, for example, 88 keys corresponding to those of an acoustic piano (hereinafter "key(s)"), ON/OFF status of each key, and the key press intensity, and a scanning circuit for scanning the touch sensor of each key under the control of the CPU 2.

The musical sound generating circuit 12 can generate, under the control of the CPU 2, independent digital musical sound signals in a plurality of channels (e. g. 32 channels in the embodiment) by time division multiprocessing, and is provided with a load circuit for loading various kinds of effects, such as pan effect and reverberation effect. The DIA converter 14 converts the digital musical sound signals which are output from the above musical sound generating circuit 12 into analog musical sound signals, and outputs them. The amplifier 16 amplifies the analog musical sound signals which are output from the D/A converter 14, and generates musical sounds through one or more loudspeaker (s). The amplification factor V of the amplifier 16 is variable according to the setting of the master volume control 20 by the user.

The ROM 4 contains control programs for generating musical sounds, according to which the CPU 2 performs a series of control processes. Firstly, the CPU2 reads out, by scanning the keyboard 10, the information about the ongoing play, such as ON/OFF of the keys, the key numbers, the key pressing speed (hereinafter "velocity value Tv"). Secondly, the CPU2 assigns certain channels to generate digital musical sound signals (musical sound generating channels). The CPU2 reads out the operating conditions of various switches arranged on the panel 8 by scanning the panel 8, and performs necessary controls of the musical sound generating channels.

Besides the above control programs, the ROM 4 contains data on musical pieces for automatic performance and various tone parameters and the like. The CPU 2 controls the musical sound generating circuit 12 to generate musical sounds for automatic performance according to the data on musical pieces for automatic performance when the automatic performance mode of the system is selected by the operation of the panel 8.

The RAM 6, which is used as the working memory of the CPU 2, also stores various control data for generating musical sounds, such as volume control touch curves and tone control touch curves, and is backed up by a battery so that it will not lose this data when the system power is turned off.

Figure 2:
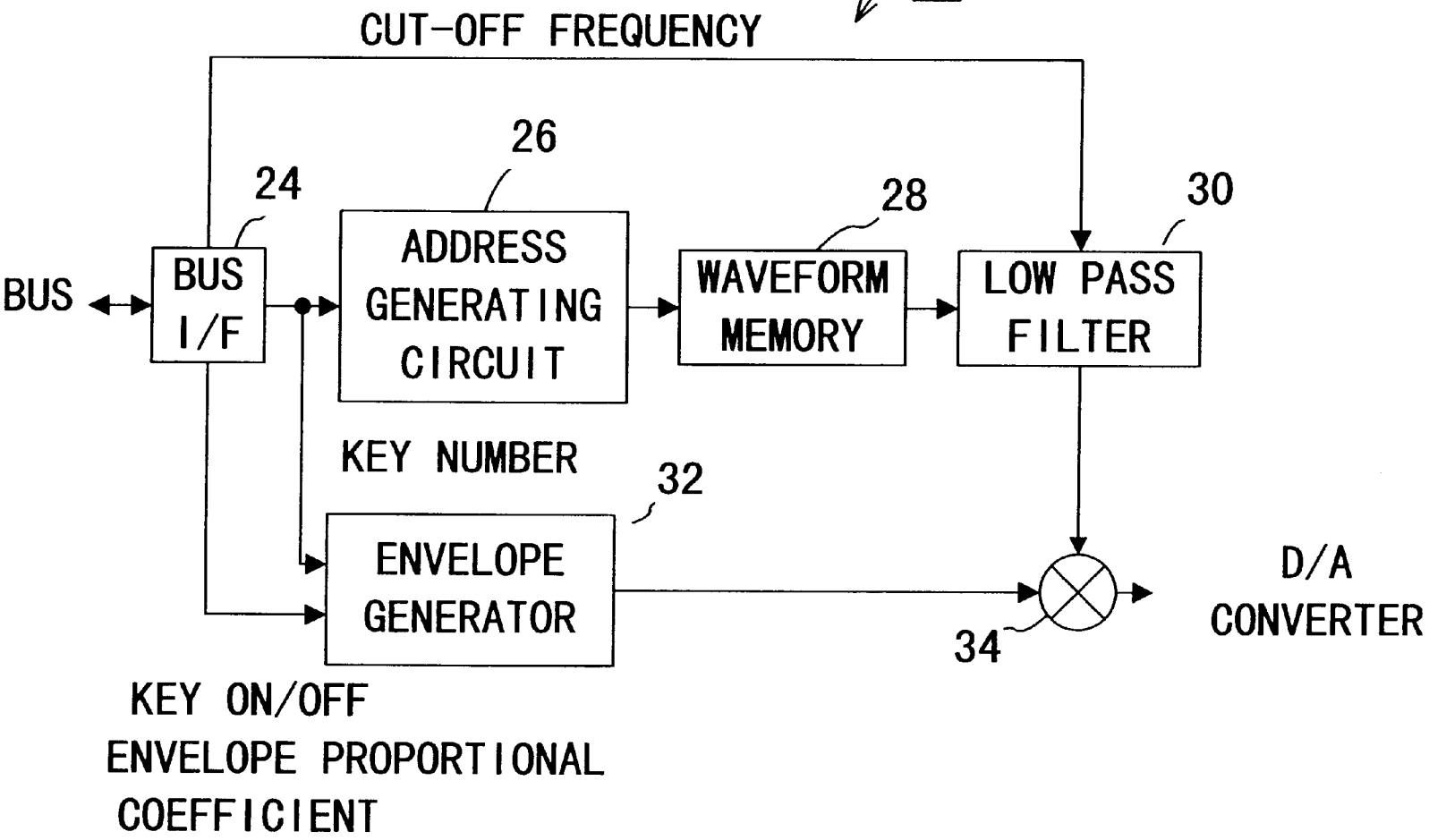
FIG. 2 is a block diagram showing the structure of the musical sound generating circuit of the electronic musical instrument in the embodiment.

FIG. 2 is a block diagram showing an example structure of the musical sound generating circuit12 according to FIG. 1. To simplify the explanation, only the function of one musical sound generating channel is shown, even though the musical sound generating circuit 12 can generate independent digital musical sound signals in 32 channels by time division multiprocessing.

As shown in FIG. 2, the musical sound generating circuit 12 is composed of a bus interface (bus I/F) 24, an address generating circuit 26, a waveform memory 28, a low pass filter 30, an envelope generator 32, and a multiplier 34. The bus interface 24 receives the data transferred from the CPU 2 through the bus 22, such as ON/OFF of a key, key number, a cut-off frequency F, and a sound envelope proportional coefficient a also mentioned later, and then transfers the data to appropriate circuits. The address generating circuit 26 generates an address for reading the waveform memory which corresponds to the sound pitch in accordance with the key number. The waveform memory 28 stores the waveform data corresponding to various kinds of tones. The low pass filter 30 performs filtering in accordance with the cut-off frequency F transferred from the CPU 2. By this filtering, among the musical sound waveforms (i.e. musical sound signals) received from the waveform memory 28, the frequency components lower than the cut-off frequency F are allowed to pass, while the gain of the frequency components higher than the cut-off frequency F are reduced as the frequency increases. The envelope generator 32 generates envelope waveform signals in accordance with ON/OFF of the keys, the key numbers, the envelope proportional coefficient a and the like. The multiplier 34 multiplies the output from the low pass filter 30 and the output from the envelope generator 32 together, then outputs the resulting musical sound signals.

In the above described electronic musical instrument, when the user presses an optional key on the keyboard 10, the CPU 2 calculates a cut-off frequency F and an envelope proportional coefficient $\alpha$ in accordance with the velocity value Tv.

Specifically, the cut-off frequency is calculated in accordance with the velocity value as follows: Previously, the cut-off frequencies corresponding respectively to the various velocity values Tv, which are detected as the key press intensity, are stored in the ROM 4 so that a musical sound with the optimum frequency distribution (i.e. in the most desirable tone) in accordance with the key press intensity can be generated through the loudspeaker 18. What is stored substantially in the ROM4 is a tone control touch curve on the coordinate plane where the velocity value Tv is used to enter one of the two coordinate axes and the cut-off frequency is used to enter the other. The tone control touch curve is shown in the lower graph of FIG. 3A (The intersecting point of the two axes does not necessarily mean that each variable is 0) there. Hereinafter the same is true, which is rotated 90° clockwise in order to indicate the correspondence to the cut-off frequency F of the low pass filter 30. When the velocity value Tv detected at the keyboard 10 is "Tva", for example, the CPU 2 refers to the tone control touch curve stored in the ROM 4 and obtains "Fa" as the cut-off frequency to be transferred to the low pass filter 30. When the velocity value is "Tvb", it obtains "Fb" as the cut-off frequency.

Figure 3A:
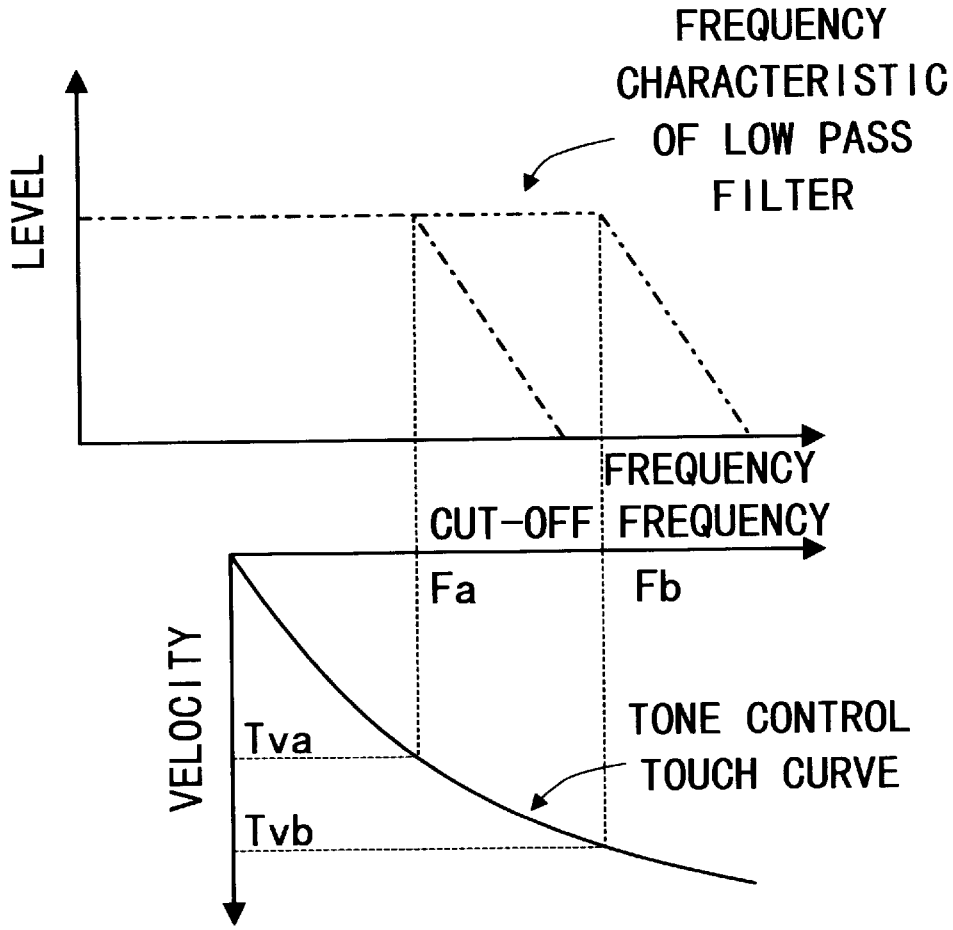
FIG. 3A is an explanatory view showing how to calculate the cut-off frequency of the low pass filter in accordance with the velocity value.

In accordance with the cut-off frequency F obtained in the aforementioned way, the frequency characteristic of the low pass filter 30 is determined as shown in the upper graph of FIG. 3A (For example, the chain line shows the frequency characteristic when the cut-off frequency F is "Fa", while the two-dot chain line shows that when the cut-off frequency F is "Fb".).

Figure 3B:
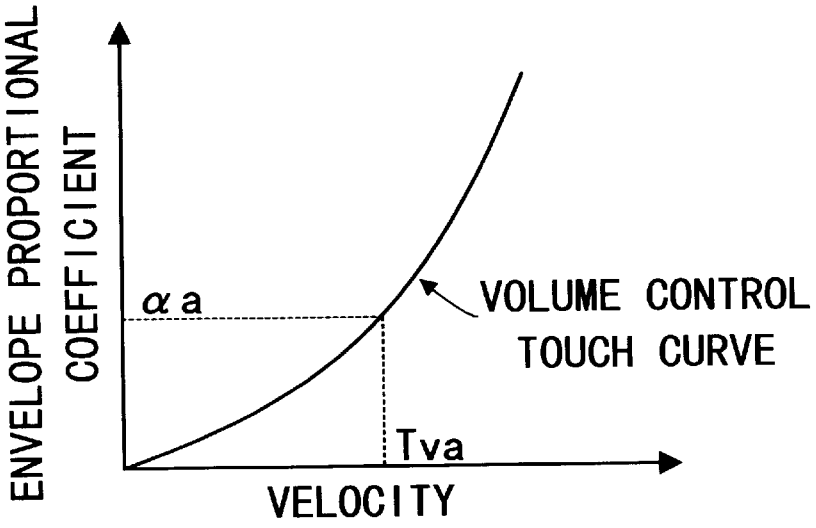
FIG. 3B is an explanatory view showing how to calculate the envelope proportional coefficient in accordance with the velocity value.

The envelope proportional coefficient a is calculated in accordance with the velocity value Tv as follows: Previously, the envelope proportional coefficients $\alpha$ corresponding respectively to the various velocity values Tv are to be stored in the ROM 4, such that the musical sound with the envelope of the optimum amplitude in accordance with the key pressing speed can be generated through the loudspeaker 18. What is stored in the ROM 4 is a volume control touch curve on the coordinate plane as shown in FIG. 3B, where the velocity value Tv is used to enter the transversal axis and the envelope proportional coefficient $\alpha$ is used to enter the axis of ordinates. When the velocity value Tv detected at the keyboard 10 is "Tva", for example, the CPU 2 refers to the volume control touch curve stored in the ROM 4 and obtains "$\alpha$a" as the envelope proportional coefficient $\alpha$ to be transferred to the envelope generator 32.

After the calculation of the cut-off frequency F and the envelope proportional coefficient $\alpha$, the CPU 2 assigns a certain channel in the musical sound generating circuit 12 and transmits, to the musical sound generating circuit 12, the channel data indicating the musical sound generating channel along with other data, such as ON/OFF of the key, the key number, the envelope proportional coefficient $\alpha$ and the cut-off frequency F.

Then, in the musical sound generating circuit 12, the musical sound signal corresponding to the key number, which is output from the waveform memory 28 in the assigned musical sound generating channel, is output through the low pass filter 30 to the multiplier 34. The low pass filter 30 performs the above described filtering of the musical sound signal output from the waveform memory 28 according to the cut-off frequency F transferred from the CPU 2. At the same time, the envelope generator 32 generates the envelope signal corresponding to the key number and multiplies the signal by the envelope proportional coefficient $\alpha$, then outputs the same to the multiplier 34. The multiplier 34 multiplies these output signals (i.e. the musical sound signal which has passed through the low pass filter 30 and the envelope signal which has been output by the envelope generator 32), and outputs the multiplied signal as a digital musical sound signal to the D/A converter 14.

The digital musical sound signal is converted into an analog musical sound signal by the D/A converter 14 and then amplified by the amplifier 16 by the amplification factor V which is set by the master volume control 20, then fed to the loudspeaker 18. As a result, a musical sound corresponding to the pressed key is produced.

In this embodiment, 32 sets of address generating circuits 26, waveform memories 28, low pass filters 30, envelope generators 32, and multipliers 34 are provided in order to generate respective independent musical signals in 32 channels by time division multiprocessing.

Figure 5A:
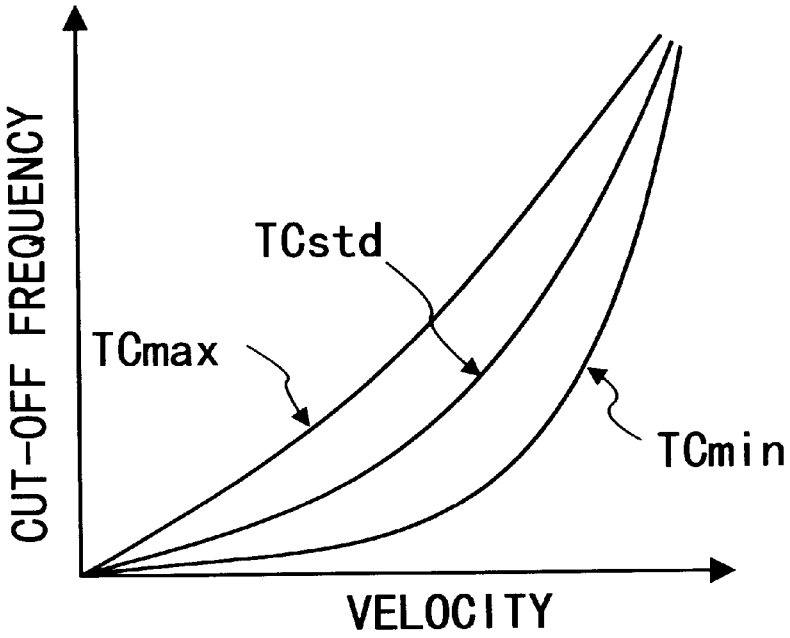
FIGS. 5A and 5B are explanatory views showing how to calculate the cut-off frequency of the low pass filter in accordance with the velocity value and the amplification factor.
Figure 5B:
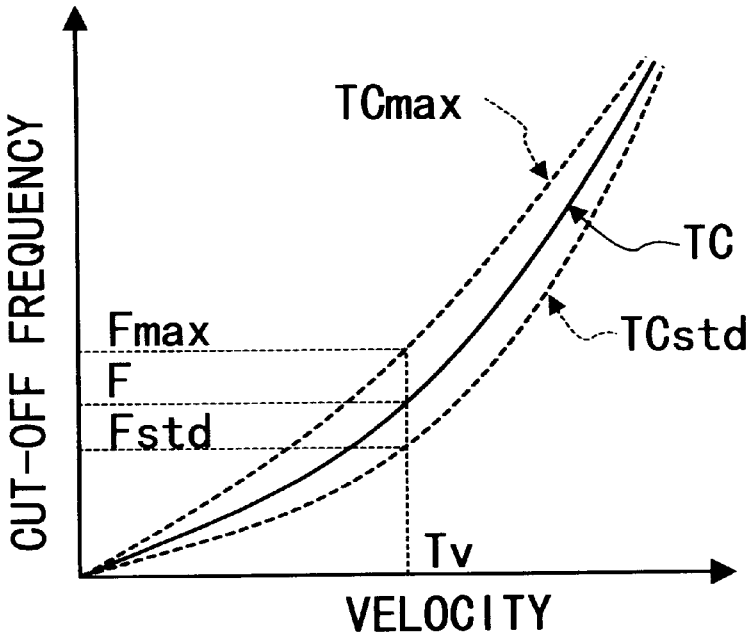

In the embodiment the ROM 4 previously stores, as shown in FIG. 5A, a standard tone control touch curve TCstd when the amplification factor V is a standard amplification factor Vstd, a maximum tone control touch curve TCmax when the amplification factor V is a maximum amplification factor Vmax, and a minimum tone control curve TCmin when the amplification factor is a minimum amplification factor Vmin. Then, by interpolating, as shown in FIG. 5B, either the standard tone control touch curve TCstd and the maximum tone control touch curve TCmax, or the standard tone control touch curve TCstd and the minimum tone control touch curve TCmim in accordance with the amplification factor V at the time of key press, the CPU 2 forms a new tone control touch curve TC, according to which it calculates a cut-off frequency F.

In this case, it is possible to detect the amplification factor V at intervals of a predetermined time and calculate the cut-off frequency F corresponding to every velocity value Tv (i.e. the whole of the above described new tone control touch curve TC) then store the same in the RAM 6. However, this imposes a heavy burden on the CPU 2 and also requires a lot of the resources of the RAM 6. Accordingly, in this embodiment, when a key is pressed, the amplification factor V is detected, and the cut-off frequency F corresponding only to the velocity value Tv of the pressed key (i.e. the frequency at a certain point on the above described new tone control touch curve TC) is calculated.

Figure 4:
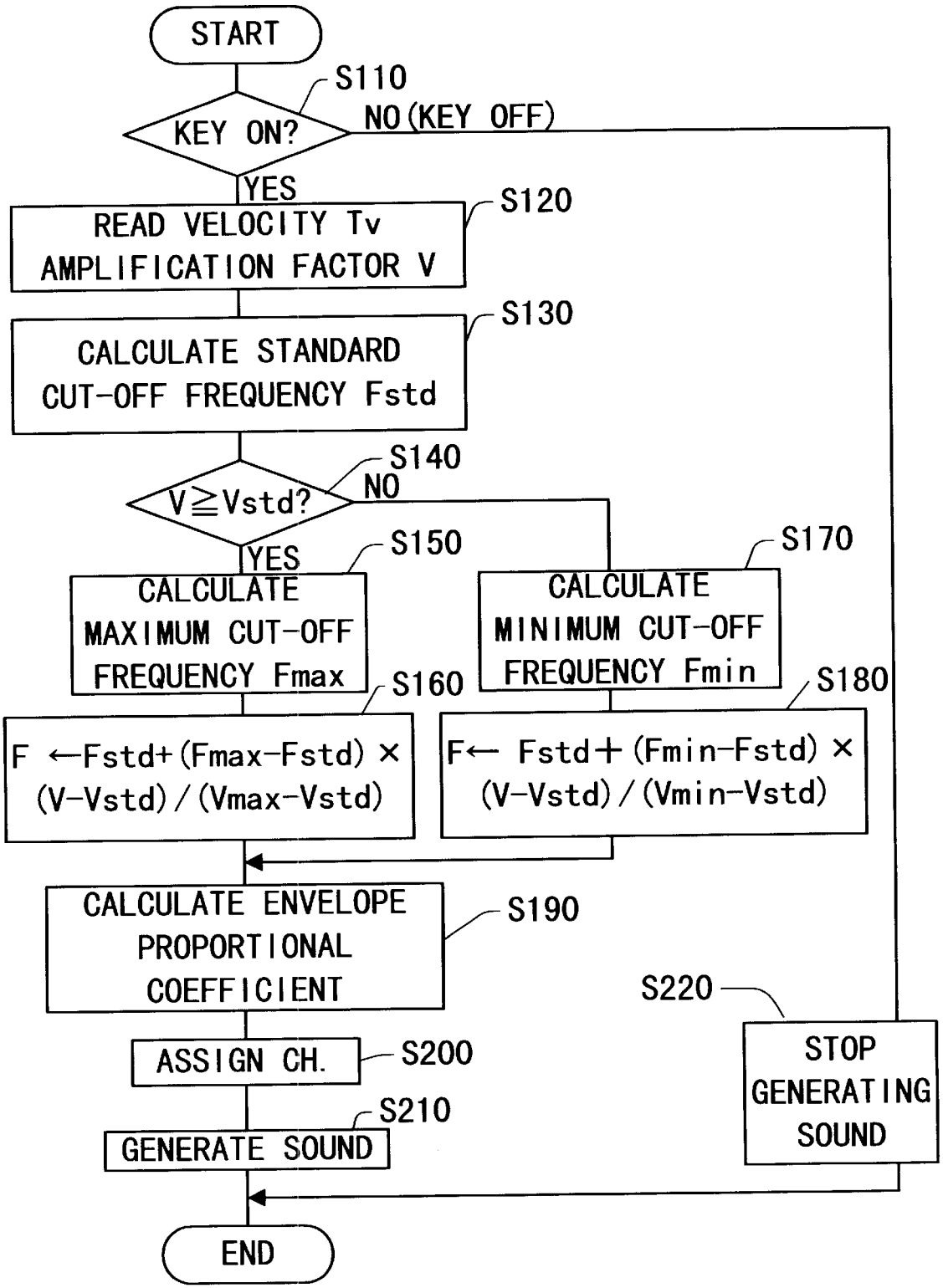
FIG. 4 is a flowchart showing the controlling process carried out by the electronic musical instrument in the embodiment.

The control process performed by the CPU 2, using ROM 4 and the RAM 6, for the aforementioned control is explained hereafter with the flowchart shown in FIG. 4.

This process is performed when the press condition (ON/OFF) of any key of the keyboard 10 is changed. When the process starts, it is determined at Step (hereinafter represented simply by "S") 110, whether the key is switched from an OFF condition to an ON condition or opposite.

When it is determined that the pressed key is switched from an OFF condition to an ON condition, the process goes on to S120, at which the velocity value Tv detected by the touch sensor corresponding to the key and the amplification factor V set by the master volume control 20 are read. At S130, as shown in FIG. 5B, the standard cut-off frequency Fstd corresponding to the velocity value Tv is obtained according to the standard tone control touch curve TCstd. Then, at S140, it is determined whether or not the set amplification factor V is higher than the standard amplification factor Vstd.

If it is determined that the amplification factor V is higher than the standard amplification factor Vstd, the process goes on to S150. At S150, as shown in FIG. 5B, the maximum cut-off frequency Fmax corresponding to the velocity value Tv is obtained according to the maximum tone control touch curve TCmax. Then at S160, interpolation between the maximum cut-off frequency Fmax and the standard cut-off frequency Fstd is performed according to the amplification factor V, and the ultimate cut-off frequency F is decided. Specifically, the cut-off frequency F is decided according to the linear function of the amplification factor V as follows:

$$F=Fstd+(Fmax-Fstd)\times(V-Vstd)/(Vmax-Vstd)$$

If it is determined that the amplification factor V is lower than the standard amplification factor Vstd, the process goes on to S170. At S170, the minimum cut-off frequency Fmin corresponding to the velocity value Tv is obtained according to the minimum tone control touch curve TCmin. Then at S180, interpolation between the minimum cut-off frequency and the standard cut-off frequency is performed according to the amplification factor V, and the ultimate cut-off frequency F is decided. Specifically, the cut-off frequency F is decided according to the linear function of the amplification factor V as follows:

$$F=Fstd+(Fmin-Fstd)\times(V-Vstd)/(Vmin-Vst)$$

After the cut-off frequency F for controlling the low pass filter is decided, the envelope proportional coefficient a corresponding to the velocity Tv is obtained according to the volume control touch curve at S190. Then at S200, a musical sound generating channel (CH.) is assigned to be used to generate a musical sound corresponding to the key. At S210, the sound generating process of transmitting the data, such as ON/OFF of the key, the key number, the cut-off frequency F, the envelope proportional coefficient $\alpha$, and the above assigned musical sound generating channel, for generating the musical sound signal corresponding to the above key in a ON condition from the musical sound generating circuit 12 is performed, and the present process ends.

When it is determined that the key condition is switched from ON to OFF at S110, the musical sound stopping process of outputting the data indicating the above switch off condition to the musical sound generating circuit 12 is performed at S220 in order to stop the musical sound signal generation from the musical sound generating channel corresponding to the key switched to a OFF condition, and the process ends.

In this embodiment, the processing at S110 by the keyboard 10 and the CPU 2 corresponds to the processing of the key press detecting means; the address generating circuit 26 and the waveform memory 28 correspond to the musical sound signal producing means; the processing from S120 to S180 by the low pass filter 30 and the CPU 2 corresponds to the processing of the filter means; the processing at S190 by the envelope generator 32, the multiplier 34, and the CPU 2 corresponds to the processing of the envelope control means; the amplifier 16 and the loudspeaker 18 correspond to the sound generating means; and the master volume control 20 corresponds to the volume setting means.

As described above, in the electronic musical instrument in the embodiment, the cut-off frequency F of the low pass filter 30 which changes the waveform of the musical sound signal (i.e. controls the frequency components of the musical sound signal) is controlled in accordance with the velocity value Tv and the amplification factor V of the amplifier 16. Accordingly, even if the key pressing speed is changed because of the mental effects which the setting of amplification factor V has on the user, the change of the tone of the generated musical sound is controlled.

The present invention has been described above with reference to the preferred embodiment. However, the invention is not limited to the above embodiment, and various changes and modifications may be made within the scope and spirit of the invention.

For instance, while three tone control touch curves are used in the above embodiment for calculating the cut-off frequency F in accordance with the amplification factor V and the velocity value Tv, the cut-off frequency F can be calculated by the interpolation as described above as long as two or more tone control touch curves are provided. Also, the interpolation can be based not only on linear function but also on optional functions, such as high-order function, logarithmic function, exponential function. Further, it is obvious that the cut-off frequency F can be determined by merely the amplification factor V and the velocity value Tv without such interpolation. The specific procedure is to use the amplification factor V to enter the X-axis and the velocity value Tv to enter the Y-axis, to prepare a two-dimensional map indicating the appropriate cut-off frequency F at respective intersections of every possible value of X and Y, and to store the map in the ROM 4. This preparation enables the determination of the cut-off frequency F simply by referring to the two-dimensional map according to the set amplification factor V and the detected velocity value Tv.

While independent digital musical sound signals in 32 channels are generated by time division multiprocessing in the embodiment, the number of channels is not limited to 32 but is optional.

In the embodiment, the cut-off frequency F of the low pass filter 30 is controlled according to the velocity value Tv and the amplification factor V, and the waveform of the musical sound signal is changed by passing through the low pass filter 30. However, changing the waveform of the musical sound signal according to the velocity value Tv and the amplification factor V can be performed without the low pass filter 30 in the musical sound generating circuit 12 shown in FIG. 2. Instead, the change can be performed when the multiplier 34 multiplies musical sound signal output from the waveform memory 28 and the envelope signal generated by the envelope generator 32, and produces the digital musical sound signal to be transmitted to the D/A converter 14.

For the above purpose, the envelope proportional $\alpha$ should be calculated according to the velocity value Tv and the amplification factor V. Specifically, the volume control touch curve shown in FIG. 3B which indicates the relation between the velocity value Tv and the envelope proportional coefficient $\alpha$ should be stored in the ROM 4 in the following three types: the standard volume control touch curve when the amplification factor V is the standard amplification factor Vstd, the maximum volume control touch curve when the amplification factor V is the maximum amplification factor Vmax, and the minimum volume control touch curve when the amplification factor V is the minimum amplification factor Vmin.

Figure 6:
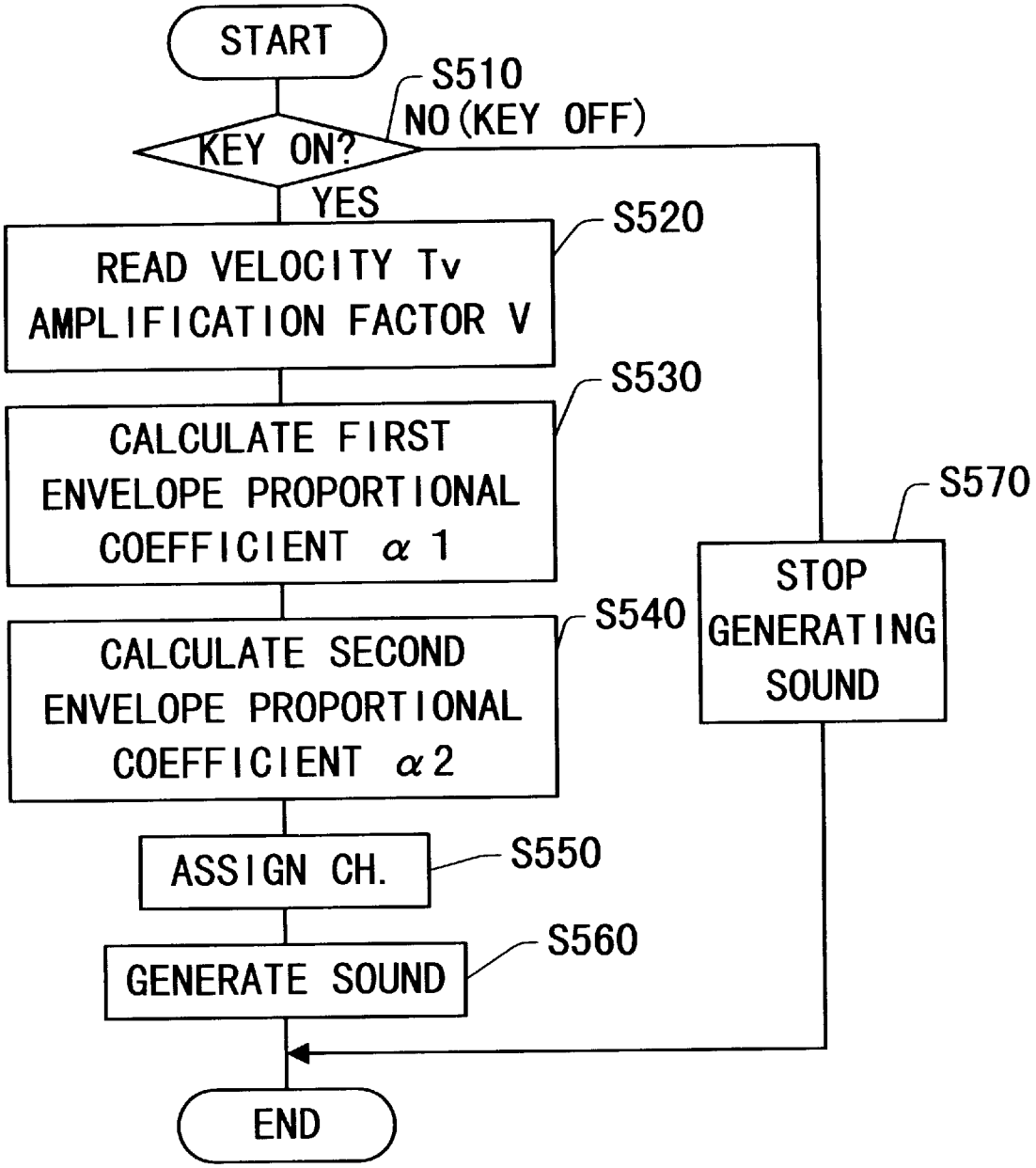
FIG. 6 is a flowchart showing a modification of of controlling process carried out by the electronic musical instrument in the embodiment.

The control process which the CPU performs by using the ROM 4 and the RAM 6 in this case is described hereinafter, according to the flowchart shown in FIG. 6.

This is also the process which starts when the condition (ON/OFF) of any key arranged on the keyboard has been changed. When the process starts, it is determined whether the key condition has been switched from OFF to ON, or the opposite (S 510). If it is determined that the condition has been switched from OFF to ON, the velocity value Tv detected by the touch sensor corresponding to the key and the amplification factor V of the amplifier 16 set by the master volume control 20 are read (S 520).

If the detected amplification factor V is higher than the standard amplification factor Vstd, the first envelope proportional coefficient $\alpha 1$ corresponding to the velocity value Tv is calculated by interpolating the maximum volume control touch curve and the standard volume control touch curve. If the detected amplification factor V is lower than the standard amplification factor Vstd, the first envelope proportional coefficient $\alpha 1$ corresponding to the velocity value Tv is calculated by interpolating the minimum volume control touch curve and the standard volume control touch curve (S 530). At the same time, the second envelope proportional coefficient $\alpha 2$ corresponding to the velocity value Tv is calculated according to the standard volume control touch curve (S540).

Then, two musical sound generating channels are assigned (S550), to one of which the information that a musical sound signal with a large amplitude of high frequency components is to be output, the first envelope proportional coefficient $\alpha 1$, ON/OFF of the key, the key number and the like are transferred, and to the other of which the information that a musical sound signal with a small amplitude of high frequency components is to be output, the second envelope proportional coefficient $\alpha 2$, ON/OFF of the key, the key number and the like are transferred (S 560).

In consequence, a musical sound signal having the envelope amplitude according to the amplification factor V and the velocity value Tv is output from one of the channels, and a musical sound signal having the envelope amplitude according to only the velocity value Tv is output from the other channel. These musical sound signals are synthesized by an adder (not shown) which is substantially a musical sound signal synthesizing means, to become the ultimate musical sound signal, according to which a musical sound is generated through the D/A converter 14, the amplifier 16, and lastly the loudspeaker 18.

If it is determined at S510 that the condition has been switched from ON to OFF, in order to stop the generation of the musical sound signal from the musical sound generating channel corresponding to the key which has been switched to OFF condition, musical sound OFF process that is to output the data which indicate the switch of key condition to the musical sound generating circuit 12 is performed, and the present process ends (S570). The above processes at S530 and S540 are substantially those of envelope controlling means.

As described above, the frequency components of the ultimate musical sound signal output to the amplifier 16 is controlled according to the velocity value Tv and the amplification factor V. In other words, even though the low pass filter 30 is not provided, the waveform of the musical sound signal can be controlled according to the velocity value Tv and the amplification factor V. Furthermore, the second envelope proportional coefficient $\alpha 2$ may be controlled according to the velocity value Tv and the amplification factor V. In this case, as the amplification factor V becomes high, the amplitude of the envelope of the musical sound signal with a small amplitude of high frequency components should be lowered. The number of assigned channels may be two or more, and the envelope proportional coefficient $\alpha$ of the musical sound signal generated from at least one of the assigned channels should be controlled according to the velocity value Tv and the amplification factor V.

It has been described that the above electronic musical instrument, the first above described, in embodiment is provided with the key board 10 and that the musical sound to be generated and its intensity are directed by the key press on the keyboard 10. However, the musical sound generating system can also be directed as to the musical sound to be generated and its intensity by an interface, for example, in conformity to MIDI Standard. In that case, the interface circuit is equivalent to the key press detecting means.

Also, it has been described that the cut-off frequency F, the envelope proportional coefficient $\alpha$, and the like are calculated by using the amplification factor V of the amplifier 16. Besides the above, however, if the master volume control 20 is made up of a variable resistor, it is possible to detect the resistance value or the position of the operating part and convert through the A/D converter, and then use them, instead of the amplification factor V, for calculating the cut-off frequency F and the envelope proportional coefficient $\alpha$.

What is claimed is:

1. A musical sound generating system comprising:

a key press detecting means for detecting which of a plurality of keys is pressed by a user and a speed at which said pressed key is pressed;

a sound generating means (16, 18) for generating a musical sound based on a musical sound signal;

a volume setting means (20) for user setting of the volume of musical sound generated by the sound generating means (16, 18); and a musical sound signal generating circuit (12) for generating a musical sound signal in response a) to said pressed key in accordance with the key pressing speed of that key detected by said key press detecting means b) and in accordance with a detected volume setting of the sound generating means (16, 18);

said musical sound signal generating means (12) generating, when the key press is detected by said key press detecting means, a musical sound signal corresponding to said pressed key i) with the amplitude of an envelope waveform in accordance with the key pressing speed detected by said key detecting means and ii) with frequency components adjusted according to said key pressing speed and the detected volume setting of the sound generating means (16, 18).

2. A musical sound generating system according to claim 1, wherein said musical sound signal generating means comprises:

a musical sound signal producing means for producing, when a key press is detected by said key press detecting means, a musical sound signal corresponding to said pressed key;

an envelope control means for controlling the amplitude of the envelope waveform corresponding to the musical sound signal produced by said musical sound signal producing means in according with the key pressing speed detected by said key press detecting means; and a filter means for controlling the frequency components of the musical sound signal produced by said musical sound signal producing means in according with the key pressing speed detected by said key detecting means and the detected volume setting.

3. A musical sound generating system according to claim 2, wherein said filter means calculates a cut-off frequency in accordance with the key pressing speed detected by said key press detecting means and the detected volume setting, and controls the frequency components of the musical sound signal produced by said musical sound signal producing means such that the amplitude of higher frequency components than said cut-off frequency is reduced.

4. A musical sound generating system according to claim 1, wherein said musical sound signal generating means comprises:

a plurality of musical sound signal producing means for producing a plurality of musical sound signals respectively with different frequency components each corresponding to a pressed key;

a plurality of envelope control means for controlling the amplitude of envelope waveforms corresponding to the musical sound signals produced respectively by said plurality of musical sound signal producing means in accordance with the key pressing speed detected by said key press detecting means; and a musical sound signal synthesizing means for combining the musical sound signals controlled respectively by said plurality of envelope control means and generating the ultimate musical sound signal;

at least one of said plurality of envelope control means controlling the amplitude of the envelope waveform corresponding to the musical sound signal produced by said musical sound signal producing means in accordance with the key pressing speed detected by said key press detecting means and the detected volume setting.

5. A method of generating sound in a musical sound generating system comprising the steps of:

a) detecting which key is pressed by a user and pressing speed at which the pressed key is pressed;

b) producing a musical sound signal corresponding to said pressed key;

c) user setting the volume of the musical sound to be generated by the system operation;

d) detecting the volume setting;

e) controlling the frequency components of the produced musical sound signal in accordance with the key pressing speed and the detected volume setting;

f) controlling the amplitude of the envelope waveform corresponding to the produced musical sound signal in accordance with the key pressing speed;

g) generating an output musical sound signal in accordance with the musical sound signal having the controlled frequency components and with the controlled envelope waveform; and h) generating a sound based on the output musical sound signal at the user set volume.

* * * * *